US010058760B1

(12) United States Patent
McWilliam

(10) Patent No.: US 10,058,760 B1
(45) Date of Patent: Aug. 28, 2018

(54) GOLF TRAINING DEVICE AND METHOD OF USING THE SAME

(71) Applicant: Matthew D. McWilliam, Ocean Pines, MD (US)

(72) Inventor: Matthew D. McWilliam, Ocean Pines, MD (US)

( * ) Notice: Subject to any disclaimer, the term of this patent is extended or adjusted under 35 U.S.C. 154(b) by 0 days.

(21) Appl. No.: 15/598,610

(22) Filed: May 18, 2017

(51) Int. Cl.
*A63B 69/36* (2006.01)

(52) U.S. Cl.
CPC ..... *A63B 69/3676* (2013.01)

(58) Field of Classification Search
USPC ..... 473/173, 174, 180, 195, 196, 270, 282, 473/409
See application file for complete search history.

(56) References Cited

U.S. PATENT DOCUMENTS 1,676,975 A * 7/1928 Anderson ..... A63B 47/00 206/315.9
2,898,110 A * 8/1959 Overbaugh ..... A63B 57/10 229/92.8
3,837,653 A * 9/1974 Fox ..... A63F 7/0628 206/579
5,950,568 A * 9/1999 Axelrod ..... A01K 1/033 119/499
2005/0145192 A1* 7/2005 Axelrod ..... A01K 1/0245 119/499
2007/0015597 A1* 1/2007 Bush, III ..... A63B 24/0003 473/261

* cited by examiner

*Primary Examiner* — Nini Legesse
(74) *Attorney, Agent, or Firm* — Maier & Maier, PLLC

(57) ABSTRACT

A golf training device and method of using the same for improving the aim and accuracy of a golfer's putting stroke may be provided. The golf training device may include a plurality of panels coupled together in an accordionlike manner to form a putting tunnel. Each panel may have a main body with visual indicium disposed on a front-facing surface thereof to indicate a line of putt. The golf training device may be extended along a proper trajectory of a golf ball for putting the golf ball toward an intended target. Orienting the golfer's putting stance so that the visual indicium of each panel appears to form a continuous straight line may ensure the golfer's eyes are directly over the intended line of the putt.

4 Claims, 6 Drawing Sheets

GOLF TRAINING DEVICE AND METHOD OF USING THE SAME

BACKGROUND

Golf is one of the most popular sports in the world. One of the most important aspects of golf is accurate putting, which can significantly improve a golfer's score and handicap. A number of factors have to be assessed and taken into consideration before attempting a putt. These include course conditions such as the speed, the degree, and shape of any slopes between the hole and the ball, and the distance and bearing of the hole from the ball. Furthermore, many individual players have poor fundamental putting mechanics. Poor mechanics may alter the travel path and face angle of the putter head relative to an intended path, which may negatively affect the impact between the putter head and the golf ball resulting in poorly hit putts. Therefore, accurate putting requires a considerable amount of practice.

The "line of putt" is the trajectory that the golfer intends his ball to take after a stroke on the putting green. Setting the eyes in the correct position is one of the critical factors in successfully executing the putt along an intended path of travel. There is thus a need for a golf putting training device that indicates whether a golfer's eyes are directly over the line of putt.

SUMMARY OF THE INVENTION

A golf training device and method of using the same for improving the aim and accuracy of a golfer's putting stroke may be provided. In one exemplary embodiment, a golf training device may be shown having a plurality of panels coupled together in an accordion-like manner to form a putting tunnel. Each panel may include a main body having a front-facing surface, a rear-facing surface, and peripheral side edges; visual indicium disposed on the front-facing surface of the main body for indicating a line of putt; and a hinge member extending a length of at least one peripheral side edge.

According to another exemplary embodiment, a method of improving the accuracy of a golfer's putting stroke may be provided. The method may include providing a golf training device, the golf training device comprising: a plurality of panels coupled together in an accordionlike fashion to form a putting tunnel, each of the plurality of panels further comprising: a main body having a front-facing surface, a rear-facing surface, and peripheral side edges; visual indicium disposed on the front-facing surface of the main body for indicating a line of putt; and a hinge member extending a length of at least one peripheral side edge; placing the golf training device on a putting surface; expanding the golf training device along an intended trajectory of a golf ball with the visual indicium centrally disposed over the line of putt; placing a golf ball on the putting surface in front of the golf training device proximate the putting tunnel; placing a putter head of a putter behind the golf ball; orienting the golfer's putting stance so that, when viewing the golf training device from the putting stance, the visual indicium of each panel appears to form a continuous straight line; striking the golf ball with the putter head while in the oriented putting stance to compel the golf ball to travel a distance within the putting tunnel.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION OF THE INVENTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

A golf training device and method of using the same for improving the aim and accuracy of a golfer's putting stroke may be provided. The golf training device may facilitate the development of proper putting technique by training a golfer to position his or her eyes over the intended line of the putt. The golf training device may provide an intended trajectory of a golf ball via an extended visual reference of a desired line of travel. Practicing with the golf training device may optimize the putting stroke by effectively conditioning a golfer's muscle memory and motor system response.

The golf training device may be configured as a collapsible putting tunnel and adapted for use in conjunction with any conventional putter, golf ball, and putting surface. The golf training device may thus provide a portable, compact, and versatile putting aid for convenient storage, transportation and assembly/disassembly.

Figure 1:
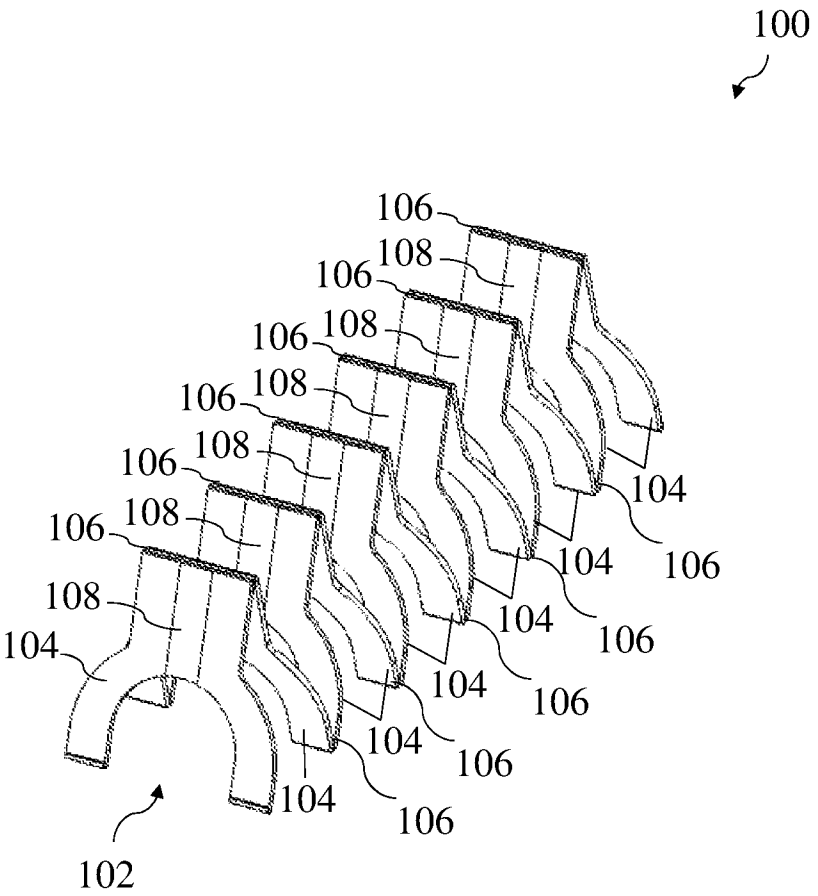
FIG. 1 may show a perspective view of an exemplary embodiment of a golf training device according to the present invention.

FIG. 1 may show a perspective view of a golf training device 100 according to the present invention. The golf training device 100 may form a putting tunnel 102 with a bottom opening that that can be positioned on a putting surface. The putting tunnel 102 may include a plurality of panels 104 coupled together in an accordionlike manner. Each panel 104 may comprise a generally Y-shaped main body having a front-facing surface, a rear-facing surface, and peripheral side edges. The front-facing surface of each panel may include visual indicium 108, such as an alignment stripe, that signifies a line of putt.

In some exemplary embodiments, and as shown in FIG. 1, the putting tunnel may consist of twelve panels 104 coupled together and arranged in series. Successive panels 104 may be pivotally connected along parallel fold lines 106 by hinge members disposed proximate peripheral side edges. The panels 102 may be arranged such that the front-facing surface of each panel 102, indicated by the visual indicium 108, faces outwardly. The panels 102 may extend upwardly at an angle which is inclined to the perpendicular with respect to the putting surface. The panels may be arranged, for example, at an angle of 45-degrees from the putting surface. The panels may be constructed from a variety of materials, including but not limited to laminated cardboard, plastic, or any other suitable material as would be understood by a person having ordinary skill in the art. The panel main body and the visual indicium disposed thereon may be of varying color. The panel main body may be, for example, a green color, and the visual indicium, for example, a white color. It should be noted that the colors are merely exemplary; in other words, the colors of any portion of the panel may be altered or customized without departing from the scope of the present invention.

Figure 2:
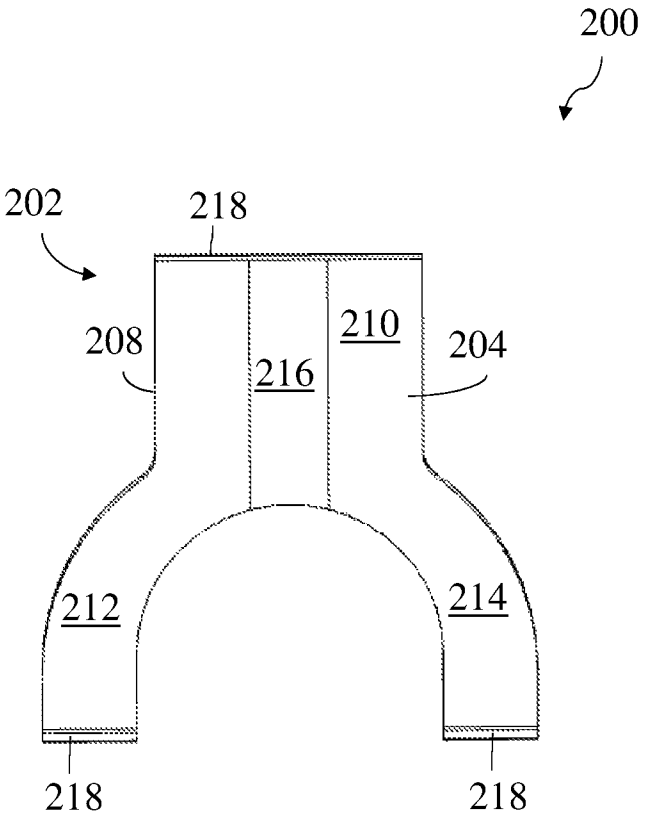
FIG. 2 may show a front view of an exemplary embodiment of a golf training device panel.
Figure 3:
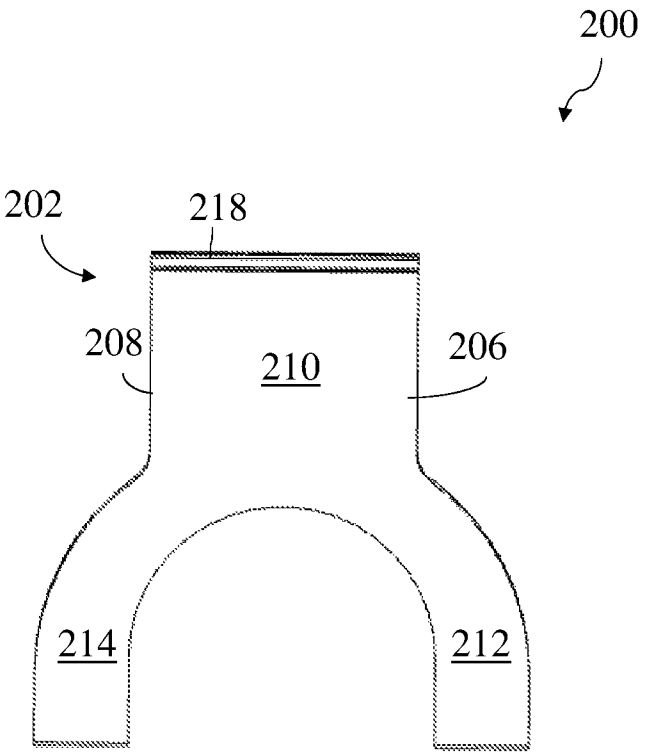
FIG. 3 may show a rear view of an exemplary embodiment of the golf training device panel of FIG. 2.

Because the panels are substantially identical, a detailed description of one, having reference to FIGS. 2-3 may suffice as a description of all. FIG. 2 may show a front view of an exemplary embodiment of a golf training device panel 200. FIG. 3 may show a rear view of the golf training device panel 200 of FIG. 2. The panel 200 may include a generally Y-shaped main body 202 having a front-facing surface 204, a rear-facing surface 206, and peripheral side edges 208. The panel main body 202 may further include an elongated base section 210 and a first prong 212 and second prong 214 extending outwardly and substantially in parallel therefrom. The archway or space provided between the first and second prongs 212, 214 may define the putting tunnel. The width of the putting tunnel and the width of the elongated base section 210 may be the exact width of a golf hole.

The front-facing surface 204 of the panel may include visual indicium 216, such as an alignment stripe, that signifies a proper trajectory of a golf ball for putting the golf ball toward the cup. The visual indicium 216 may extend the length of the elongated base section 210 to define a line segment. In some exemplary embodiments, the width of the line segment may be less than the width of a golf ball. Alternatively, the width of the line segment may be the exact width of a golf ball. A panel mounting member 218 may be provided along an upper peripheral edge and lower peripheral edges of the panel 200 for hingedly connecting successive panels together.

Figure 4:
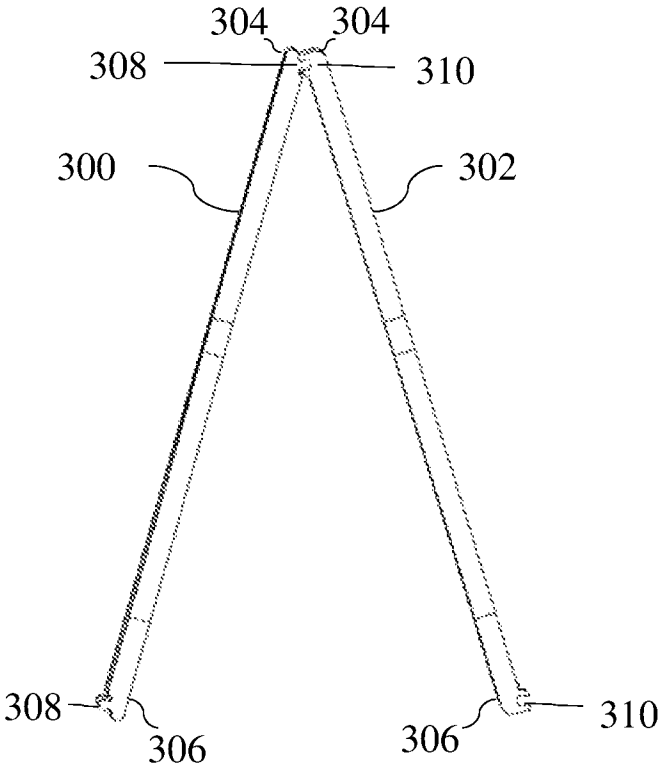
FIG. 4 may show an enlarged side view of an exemplary embodiment of two adjoining golf training device panels.

FIG. 4 may show an enlarged side view of an exemplary embodiment of two adjoining golf training device panels 300, 302. A panel mounting member may be provided along the upper peripheral edge 304 and lower peripheral edges 306 of each panel 300, 302 for hingedly connecting successive panels. The panel mounting member may be complementary hinge members, for example, an elongated tab 308 configured to extend into an elongated groove 310 of substantially circular cross-section. Each panel may be molded with a specific complimentary hinge member. Successive panels may have alternating complementary hinge members that securely fasten or mate together.

Figure 5:
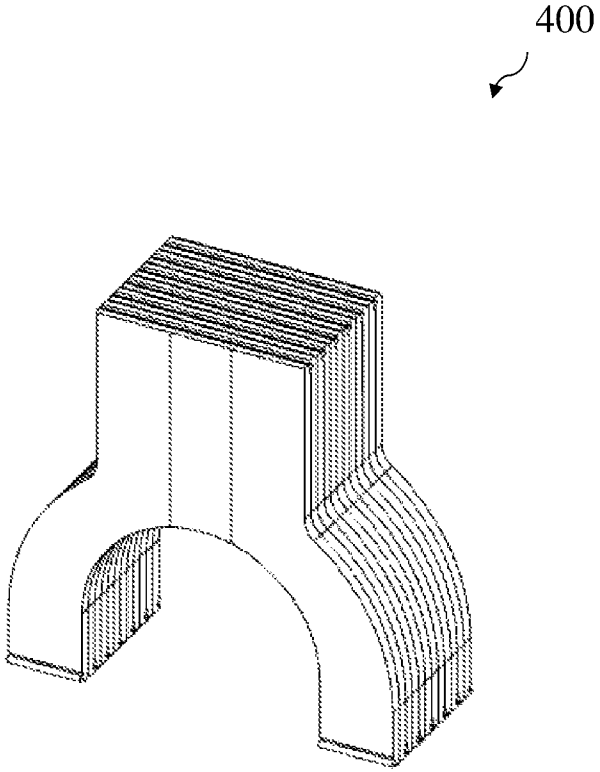
FIG. 5 may show a perspective view of an exemplary embodiment of a golf training device in a folded configuration.

FIG. 5 may show a perspective view of an exemplary embodiment of a golf training device 400 in a folded configuration. The golf training device may be moveable between an open configuration, wherein the plurality of panels form an elongated putting tunnel, and a closed configuration, wherein the plurality of panels form a stack. The plurality of panels may thus be capable of folding together into a compact, easily transportable state. Folding of the golf training device 400 may be initiated by the inward folding of the outermost panels. The several panels to be folded and unfolded may be connected by panel mounting members, such as complementary hinge members. When the golf training device 400 is folded, adjacent panels may be stacked together to form a compact structure.

In use, the golf training device may facilitate the development of proper putting technique by training a golfer to position his or her eyes over the intended line of the putt. The golf training device may be compatible with any putting surface, and positioned thereon so that the putting tunnel opening is proximate the putting surface. From a folded configuration, as shown in FIG. 5, the golf training device may be expanded along an intended trajectory of a golf ball with the visual indicium centrally disposed over the line of putt. A golf ball may be placed on the putting surface in front of the golf training device proximate the putting tunnel. The golf training device may be positioned, for example, between a golf ball and an intended target. In some exemplary embodiments, the intended target may be a golf hole.

Figure 6:
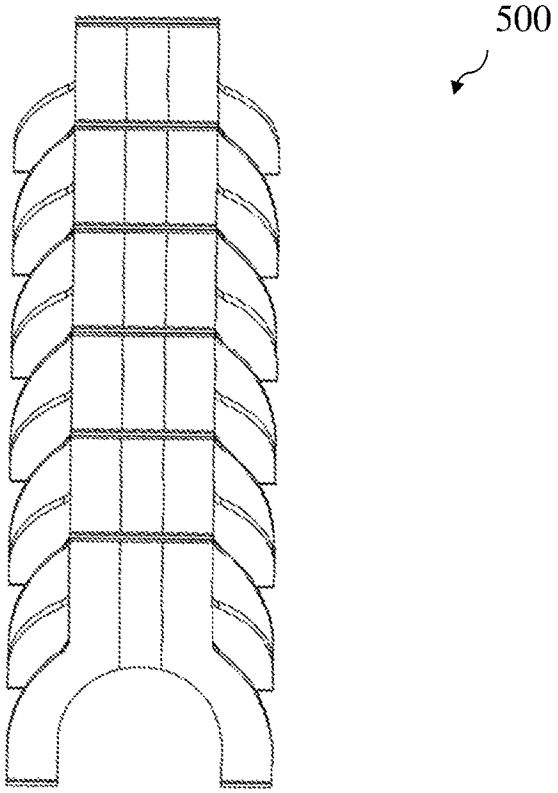
FIG. 6 may show a perspective view of an exemplary embodiment of a golf training device.

A golfer may address the putt, from either a right handed or left handed perspective, by placing the head of a putter behind the ball. A golfer may place a putter head behind the golf ball and assume a normal putting position. The golfer may then orient his or her body, head and/or eye positioning so that, when viewing the golf training device from the putting stance, the visual indicium of each panel appears to form a continuous straight line, as is shown in FIG. 6 of an exemplary embodiment of the golf training device 500. From this position, the golfer may aim his or her putting stroke through the tunnel, and in particular toward the continuous straight line. The golfer may swing the putter back during the backswing, and then proceed to strike the golf ball with the putter head while in the oriented putting stance to compel the golf ball to travel a distance within the putting tunnel. Thus, the golf training device of the present invention may train the golfer to consistently hit a putt with the golfer's eyes directly over the line of putt.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A method of improving a golfer's putting stroke, comprising:

providing a golf training device, the golf training device comprising:

a plurality of accordion-like panels coupled together to form a putting tunnel, each of the plurality of panels further comprising:

a main body having a front-facing surface, a rear-facing surface, and peripheral side edges;

visual indicium disposed on the front-facing surface of the main body for indicating a line of putt; and a hinge member extending a length of at least one peripheral side edge;

placing the golf training device on a putting surface;

expanding the golf training device along an intended trajectory of a golf ball with the visual indicium centrally disposed over the line of putt;

placing a golf ball on the putting surface in front of the golf training device proximate the putting tunnel;

placing a putter head of a putter behind the golf ball;

orienting a putting stance so that, when viewing the golf training device from the putting stance, the visual indicium of each panel appears to form a continuous straight line;

striking the golf ball with the putter head while in the putting stance to compel the golf ball to travel a distance within the putting tunnel.

2. The method of claim 1, further comprising:

aiming a putt at the continuous straight line.

3. The method of claim 1, further comprising:

positioning the golf training device between a golf ball and an intended target.

4. The method of claim 3, wherein the intended target is a golf hole.

* * * * *